US012029301B2

(12) United States Patent
Peat et al.

(10) Patent No.: US 12,029,301 B2
(45) **Date of Patent: *Jul. 9, 2024**

(54) APPARATUS, KIT, AND METHOD FOR DECORATING NAILS

(71) Applicant: SPIN MASTER LTD., Toronto (CA)

(72) Inventors: Emma J. E. Peat, Toronto (CA); Jessica Livingston, Ottawa (CA); Kyra Crilly, Toronto (CA); Paul A. Reynolds, Toronto (CA); Mollie B. Jameson, Toronto (CA)

(73) Assignee: SPIN MASTER LTD., Toronto (CA)

( * ) Notice: Subject to any disclaimer, the term of this patent is extended or adjusted under 35 U.S.C. 154(b) by 365 days.

This patent is subject to a terminal disclaimer.

(21) Appl. No.: 17/304,436

(22) Filed: Jun. 21, 2021

(65) Prior Publication Data

US 2021/0307482 A1 Oct. 7, 2021

Related U.S. Application Data

(63) Continuation of application No. 16/230,276, filed on Dec. 21, 2018, now Pat. No. 11,064,785.
(Continued)

(51) Int. Cl.
*A45D 29/00* (2006.01)
*A45D 31/00* (2006.01)
(Continued)

(52) U.S. Cl.
CPC ..... *A45D 29/004* (2013.01); *A45D 31/00* (2013.01); *A45D 29/001* (2013.01);
(Continued)

(58) Field of Classification Search
CPC ..... A45D 29/004; A45D 2044/007; A45D 31/00; A45D 2029/005; B41J 3/4075
See application file for complete search history.

(56) References Cited

U.S. PATENT DOCUMENTS 2,580,739 A 1/1952 Delno
5,931,166 A 8/1999 Weber
(Continued)

FOREIGN PATENT DOCUMENTS

JP 2006-130052 A 5/2006
JP 2006130052 A 5/2006
(Continued)

OTHER PUBLICATIONS

Extended European Search Report dated Dec. 13, 2019 in connection with European application No. 19196491.5.
(Continued)

*Primary Examiner* — Nicholas D Lucchesi
(74) *Attorney, Agent, or Firm* — Aird & McBurney LP

(57) ABSTRACT

An apparatus for applying a decal to a nail of a human includes a housing having a cartridge recess, a cartridge that includes a supply spool around which a tape is at least partially wound, the tape having at least one decal that is transferrable to a nail of a human digit, and a take-up spool that includes a tape grip that holds an end of the tape, wherein the cartridge is removably mountable in the cartridge recess, an actuator coupled to the housing and moveable between an unactuated position and an actuated position, a tape advancement arrangement and a decal actuation surface are provided. The tape advancement arrangement coupled to the actuator and arranged to rotate the take-up spool to extend the tape from the supply spool during movement of the actuator between the unactuated position and the actuated position.

9 Claims, 14 Drawing Sheets

Related U.S. Application Data

(60) Provisional application No. 62/730,350, filed on Sep. 12, 2018.

(51) Int. Cl.
*A45D 29/22* (2006.01)
*A45D 44/00* (2006.01)

(52) U.S. Cl.
CPC ..... *A45D 2029/005* (2013.01); *A45D 29/22* (2013.01); *A45D 44/005* (2013.01); *A45D 2044/007* (2013.01)

(56) References Cited

U.S. PATENT DOCUMENTS

| | | | | |
|---|---|---|---|---|
| 6,286,517 | B1 * | 9/2001 | Weber | A45D 34/04 132/73 |
| 2005/0174367 | A1 | 8/2005 | Kondo | |
| 2010/0158598 | A1 | 6/2010 | Brown | |
| 2011/0304877 | A1 | 12/2011 | Bitoh | |
| 2015/0335131 | A1 | 11/2015 | Ortiz | |
| 2016/0106193 | A1 | 4/2016 | Lawrence | |
| 2017/0172281 | A1 | 6/2017 | Crescimanno | |
| 2017/0215550 | A1 | 8/2017 | Walia et al. | |
| 2019/0021467 | A1 | 1/2019 | Sato | |
| 2020/0221849 | A1 | 7/2020 | Lin | |
| 2021/0120935 | A1 * | 4/2021 | Shashou | A45D 29/20 |

FOREIGN PATENT DOCUMENTS

| | | | |
|---|---|---|---|
| KR | 1999-0037822 | A | 5/1999 |
| WO | 2019115982 | A1 | 6/2019 |

OTHER PUBLICATIONS

European Search Report dated Sep. 28, 2021 in connection with European application No. 21179721.2.
EP 22173573.1, European Search Report, dated Jan. 20, 2023, European Patent Office.
English translation of JP 2006-130052.
EP 22173573.1, European Search Report, dated Jul. 26, 2022, European Patent Office.

* cited by examiner

APPARATUS, KIT, AND METHOD FOR DECORATING NAILS

CROSS-REFERENCE TO RELATED APPLICATIONS

This application claims the benefit of U.S. patent application Ser. No. 16/230,276, filed on Dec. 21, 2018, which claims the benefit of U.S. Provisional Application No. 62/730,350, filed Sep. 12, 2018, the contents of which are incorporated herein by reference in their entirety.

FIELD

The specification relates generally to crafts. In particular, the following relates to an apparatus, kit, and method for decorating nails.

SUMMARY OF THE DISCLOSURE

In one aspect, there is provided an apparatus for decorating nails, comprising: a housing having a rotation support structure dimensioned to rotatably support a supply spool around which a tape is at least partially wound, the tape having at least one decal that is transferrable to a nail of a human digit; an actuator coupled to the housing and moveable between an unactuated position and an actuated position; a tape advancement arrangement coupled to the actuator and arranged to actuate a tape grip to extend the tape from the first spool as the actuator is moved from the unactuated position to the actuated position and back to the unactuated position; and a decal application surface coupled to at least one of the housing and the actuator, the decal application surface being sufficiently pliable to conform to a range of nail shapes and sufficiently firm to press the tape against the nail when the actuator is moved towards the actuated position to transfer at least one of the at least one decal from the tape to the nail.

The tape advancement arrangement can extend at least a predefined length of the tape from the first spool as the actuator is moved from the unactuated position to the actuated position and back to the unactuated position. The actuator can be biased towards the unactuated position via at least one biasing element.

The apparatus can further include a deflector coupled to the actuator and having the decal application surface, the deflector being movable, via movement of the actuator from the unactuated position to the actuated position, to deflect at least one of a span of the tape extending between the first spool and the tape grip, and a finger of a user such that the span of the tape and the finger are moved into contact with one another. The deflector can deflect the span of the tape extending between the supply spool and the tape grip when the actuator is moved from the unactuated position to the actuated position.

The tape advancement arrangement can actuate the tape grip to extend the tape as the actuator is moved from the actuated position to the unactuated position. The tape grip can be unactuated by the tape advancement arrangement as the actuator is moved from the unactuated position to the actuated position.

The apparatus can further include a cartridge that is separable from the housing and rotatably supporting the supply spool. The apparatus can further include a take-up spool positioned within the cartridge and including the tape grip, the take-up spool being rotated by the tape advancement arrangement to receive the tape dispensed by the supply spool. The apparatus can further include a rotation inhibitor coupled to the actuator and inhibiting rotation of the supply spool when the actuator is in the unactuated position. The rotation inhibitor can be biased into urged against the supply spool when the actuator is in the unactuated position. The rotation inhibitor can inhibit rotation of the supply spool via friction.

The tape advancement arrangement can include a ratcheted gear that is unrotated as the actuator is moved from the unactuated position to the actuated position, and rotated as the actuator is moved from the actuated position to the unactuated position.

In another aspect, there is provided a kit for decorating nails, comprising: a nail polish that, when applied to a nail of a human digit and dried, has a tacky surface; and a decal application product, including a substrate and at least one decal adhered to the substrate, the at least one decal and the substrate having a first adhesion coefficient therebetween, wherein the at least one decal and the tacky surface of the nail polish have a second adhesion coefficient that is greater than the first adhesion coefficient, and wherein the at least one decal and an uncoated surface of the nail have a third adhesion coefficient that is lesser than the first adhesion coefficient.

The at least one decal and a surface of a dried regular nail polish coat applied to the nail can have a fourth adhesion coefficient that is lesser than the first adhesion coefficient. The nail polish can comprise a first nail polish, and the kit can further include a second nail polish that adheres to the first nail polish when the first nail polish is dry, and a subset of the at least one decal adhered to the first nail polish.

The decal application product can be a tape and the at least one decal can be a plurality of decals.

The kit further can include: a decal application apparatus, comprising: a housing having a rotation support structure dimensioned to rotatably support a supply spool around which the tape is at least partially wound; an actuator coupled to the housing and moveable between an unactuated position and an actuated position; a tape advancement arrangement coupled to the actuator and arranged to actuate a tape grip to extend the tape from the first spool as the actuator is moved from the unactuated position to the actuated position and back to the unactuated position; and a decal application surface coupled to at least one of the housing and the actuator, the decal application surface being sufficiently pliable to conform to a range of nail shapes and sufficiently firm to press the tape against the nail when the actuator is moved towards the actuated position to transfer at least one of the at least one decal from the tape to the nail.

The kit can further include a cartridge that is separable from the housing and rotatably supporting the supply spool. The kit can further include a take-up spool positioned within the cartridge and including the tape grip, the take-up spool being rotated by the tape advancement arrangement to receive the tape dispensed by the supply spool. The kit can further include a rotation inhibitor coupled to the actuator and inhibiting rotation of the supply spool when the actuator is in the unactuated position. The rotation inhibitor can be biased into urged against the supply spool when the actuator is in the unactuated position. The rotation inhibitor can inhibit rotation of the supply spool via friction.

The tape advancement arrangement can include a ratcheted gear that is unrotated as the actuator is moved from the unactuated position to the actuated position, and rotated as the actuator is moved from the actuated position to the unactuated position.

In a further aspect, there is provided a method of applying a decal to a nail of a human digit, comprising: applying a base coat of a first nail polish to a nail of a human digit, the base coat of the first nail polish having a tacky surface when dried; pressing a decal application product against the tacky surface of the base coat, the decal application product including a substrate and at least one decal adhered to the substrate, the at least one decal and the substrate having a first adhesion coefficient therebetween, the at least one decal and the tacky surface of the base nail polish having a second adhesion coefficient that is greater than the first adhesion coefficient to cause a subset of the at least one decal to adhere to the base coat when the decal application product is pressed against the tacky surface of the base coat, and the at least one decal and an uncoated surface of the nail having a third adhesion coefficient that is lesser than the first adhesion coefficient; and applying a top coat of a second nail polish atop of the base coat and the subset of the at least one decal to seal the subset of the at least one decal and the base coat.

The at least one decal and a surface of a dried regular nail polish coat applied to the nail can have a fourth adhesion coefficient that is lesser than the first adhesion coefficient.

According to yet another aspect, there is provided a nail polish that, when applied to a nail of a human digit and dry, has a tacky surface.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
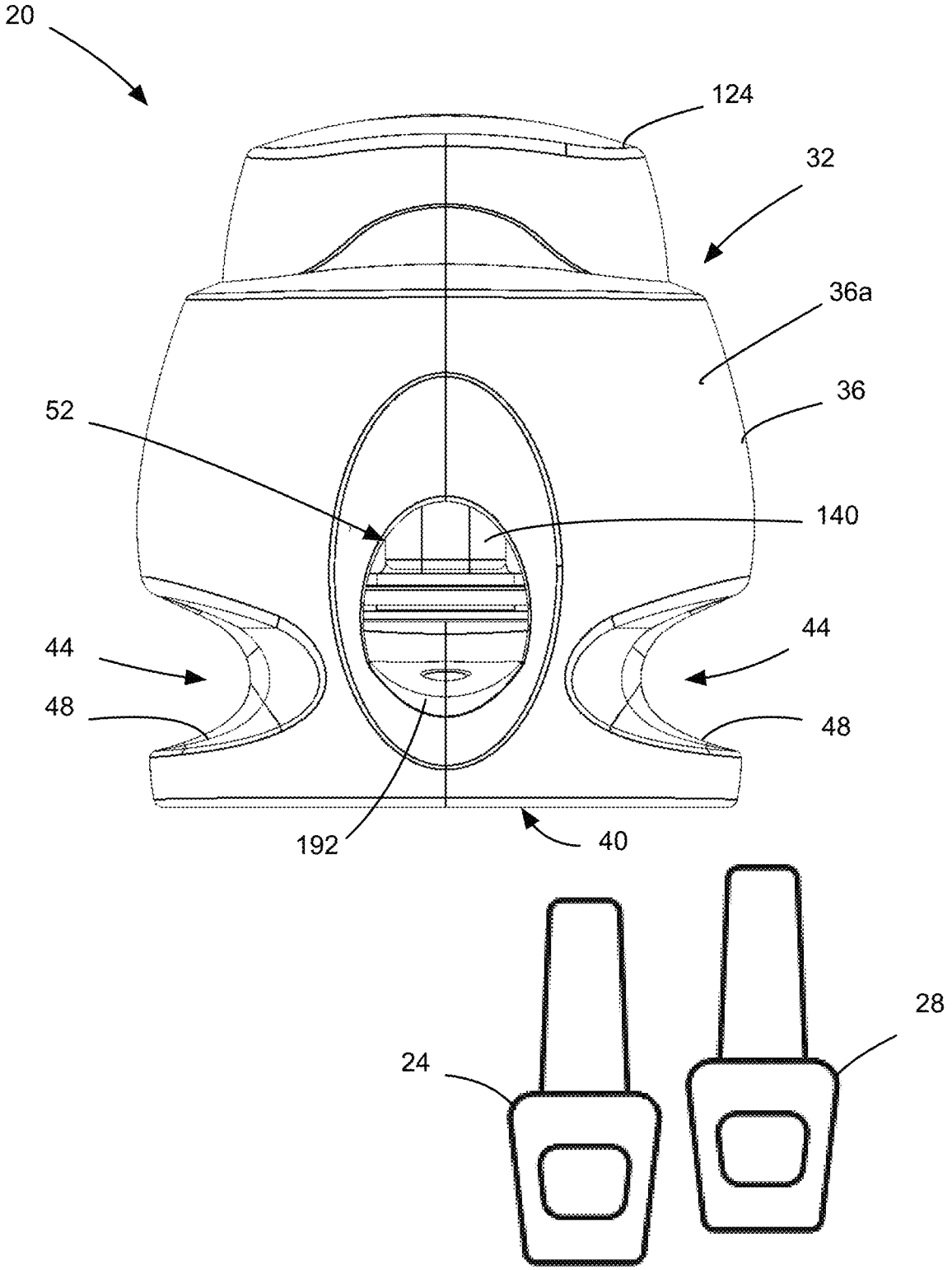
FIG. 1 shows a kit for applying a decal to a nail of a human digit in accordance with one embodiment thereof.
Figure 2:
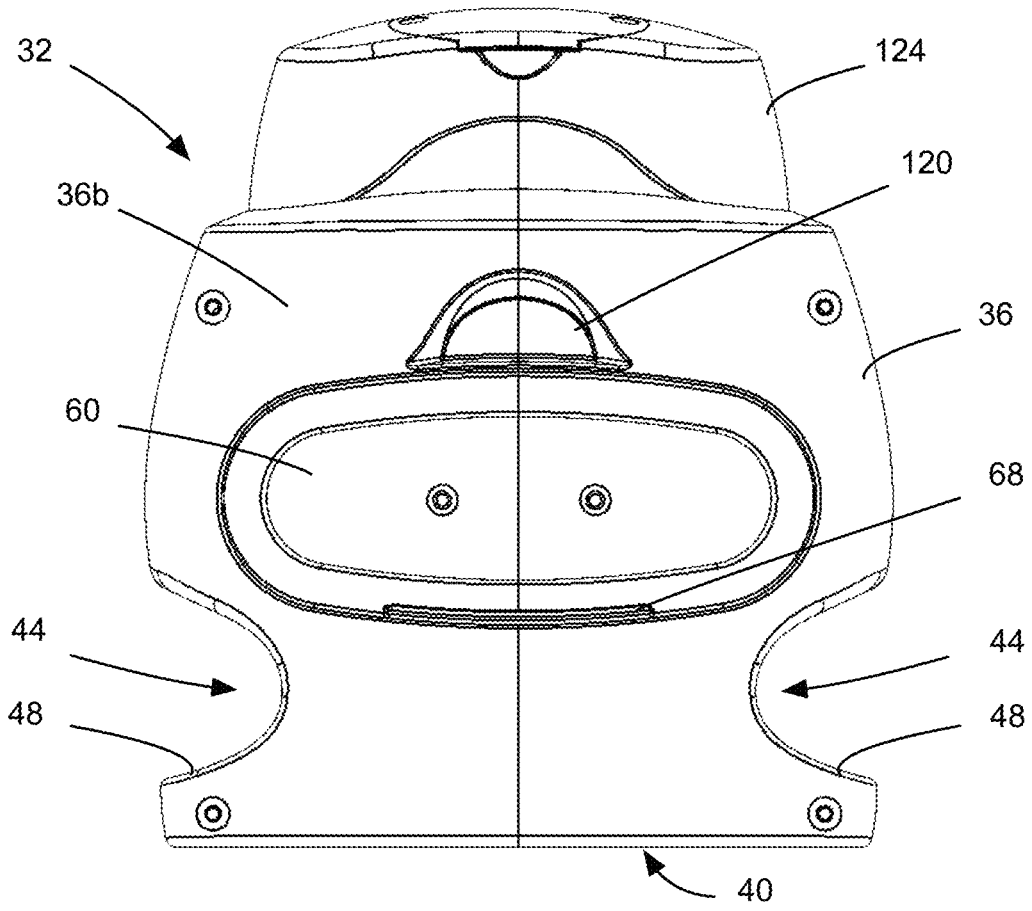
FIG. 2 is a rear view of an apparatus for applying a decal to a nail of a human digit forming part of the kit of FIG. 1.
Figure 3:
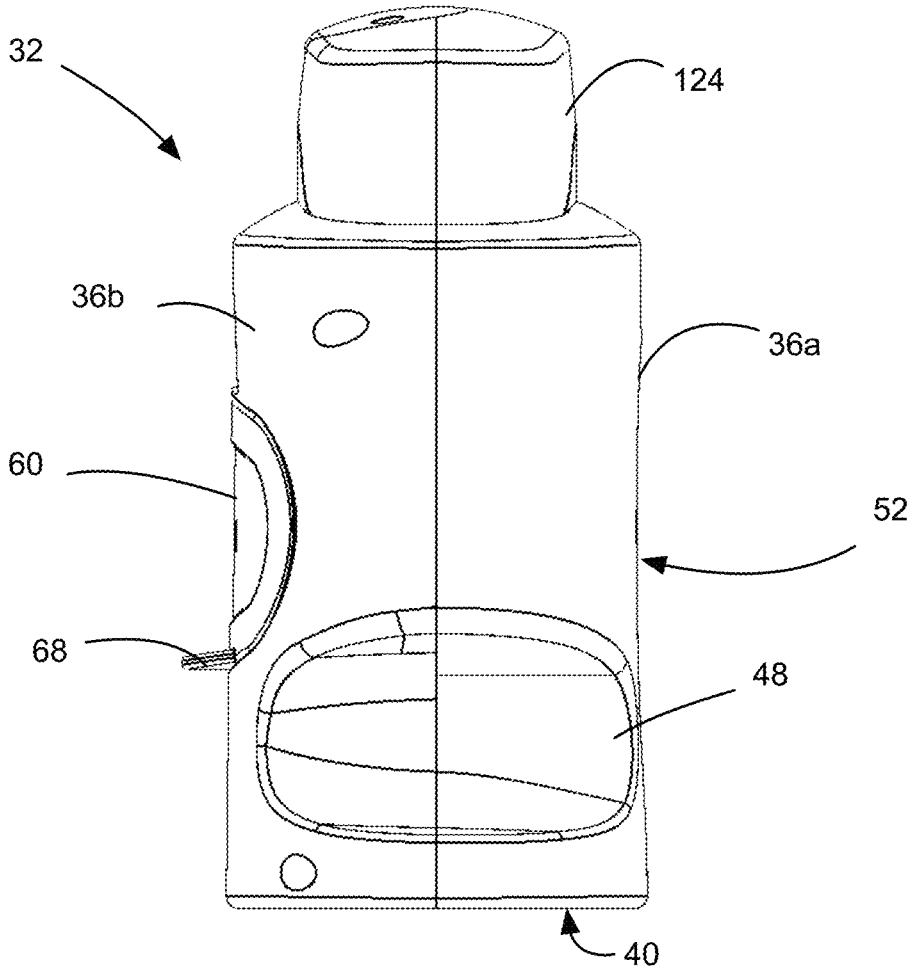
FIG. 3 is a left side view of the apparatus of FIG. 2.
Figure 4:
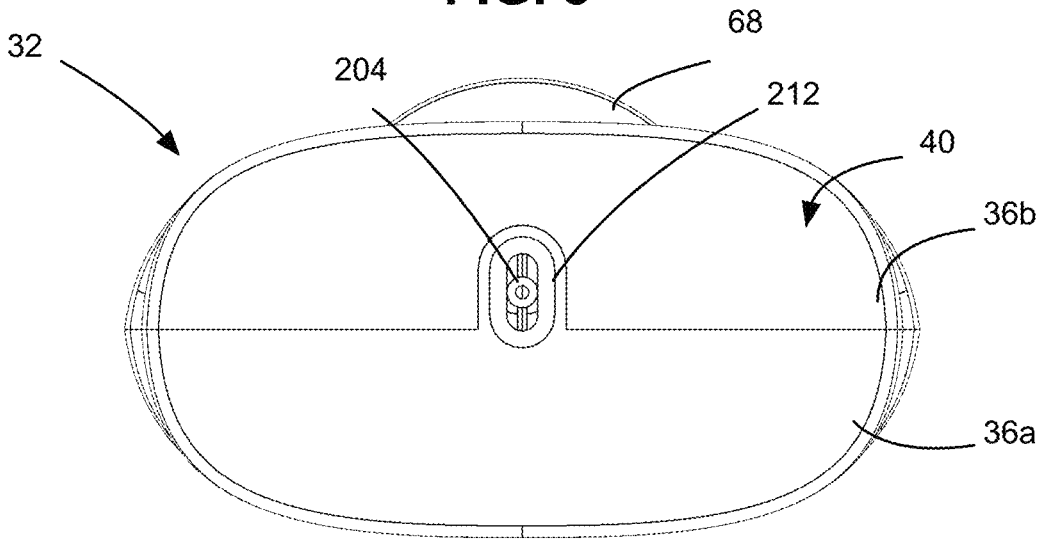
FIG. 4 is a bottom view of the apparatus of FIG. 2.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

FIG. 1 shows a kit 20 for applying a decal to a nail of a human digit in accordance with one embodiment thereof. The kit 20 includes a base nail polish 24, a top nail polish 28, and a decal application apparatus referred to as a nail printer 32.

The base nail polish 24 is a nail polish to be applied to a nail in the same manner as a regular nail polish. When a base coat of the base nail polish 24 is applied to a nail and let dry, its dried surface remains tacky. The base nail polish 24 can be provided in a variety of colors, can be partially transparent, or can be fully transparent, can be impregnated with glitter or other elements, or may have any other suitable appearance.

In a present embodiment, the base nail polish 24 includes, by weight, 25-43% Dow.™ Primal™ AC-8104 acrylic emulsion, 35-45% Dow™ Acrysol™ TT-935ER, 0.7-2.2% Dow™ Acrysol™ ASE-60 thickener, 0.5-0.65% phenoxyethanol, 0.1-0.2% iodopropynyl butylcarbamate, and 8.95-38.7% water.

The top nail polish 28 is a nail polish that is also to be applied to a nail in the same manner as a regular nail polish. Like a regular nail polish, when a top coat of the top nail polish 28 is applied atop of the base coat of the base nail polish 24 and let dry, its dried surface is generally not tacky and is typically smooth. The top nail polish 28 is formulated to adhere to the base coat of the base nail polish 24 once dry. The top nail polish 28 can be transparent, at least partially transparent, or opaque. Further, the top nail polish 28 can be impregnated with glitter or other elements to provide texture to the finished nail coat.

Now referring to FIGS. 1 to 4, the nail printer 32 is an apparatus for applying decals from a decal application product to nails. In particular, the decal application product is a cellophane substrate in the form of a tape with a plurality of decals that resides in a replaceable cartridge. The decals adhere to the cellophane substrate but not strongly.

The nail printer 32 has a housing 36 primarily formed from a front housing section 36*a* and a rear housing section 36*b* that are secured to each other. In the illustrated example, the front housing section 36*a* and the rear housing section 36*b* are secured to one another via a set of screws. Each of the front housing section 36*a* and the rear housing section 36*b* has a flat bottom region that collectively forms a bottom surface 40 of the housing 36. The flat bottom surface 40 enables the nail printer 32 to be placed securely atop of a generally flat surface such as a table top. A pair of indents 44 are formed in the sides of the housing 36. The housing 36 has a pair of grip surfaces 48 in the indents 44 to enable a person to steadily hold the nail printer 32. A finger aperture 52 extends through the front housing section 36*a* enabling a finger to be inserted into the nail printer 32.

Figure 5:
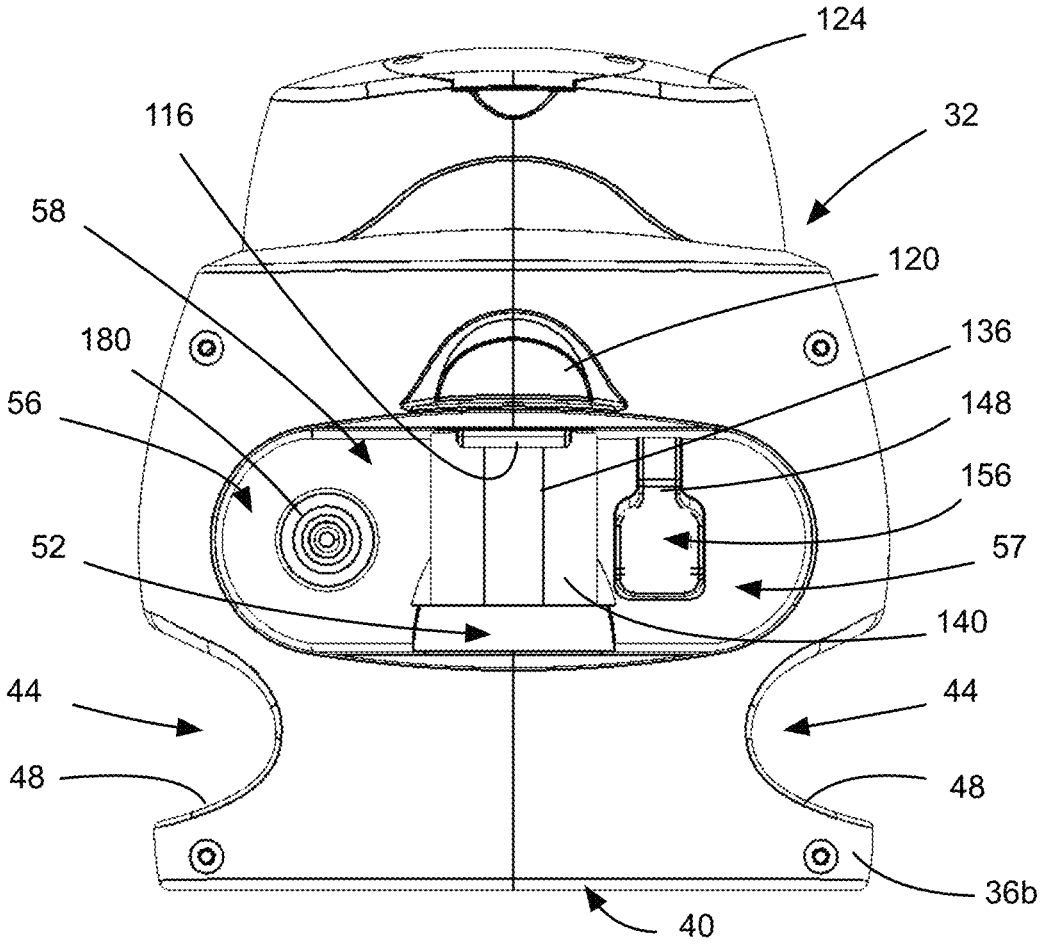
FIG. 5 is a rear view of the apparatus of FIG. 2 after removal of a cartridge of decal application tape.
Figure 6:
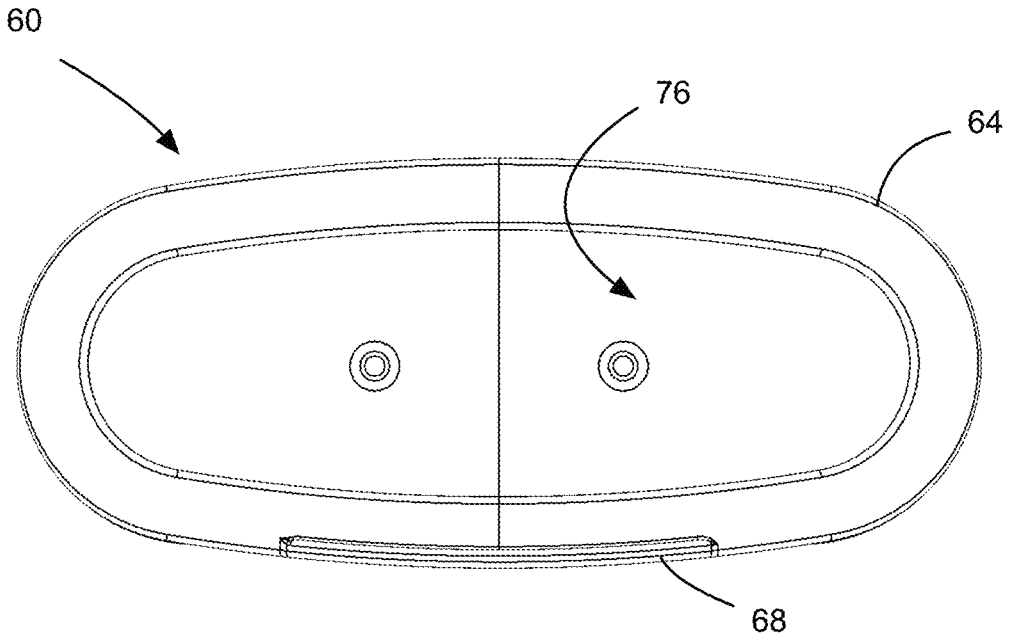
FIG. 6 shows a rear view of the cartridge of decal application tape used in the apparatus of FIG. 2.
Figure 7:
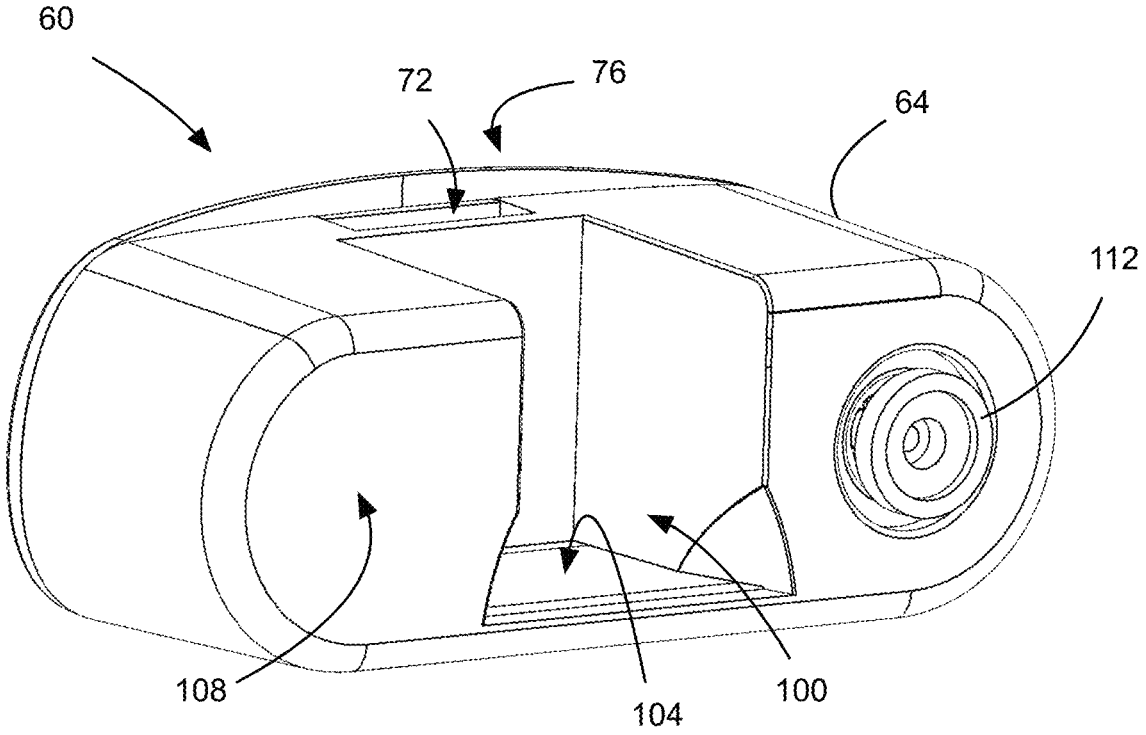
FIG. 7 shows a top, front, left side perspective view of the cartridge of decal tape of FIG. 6.
Figure 8:
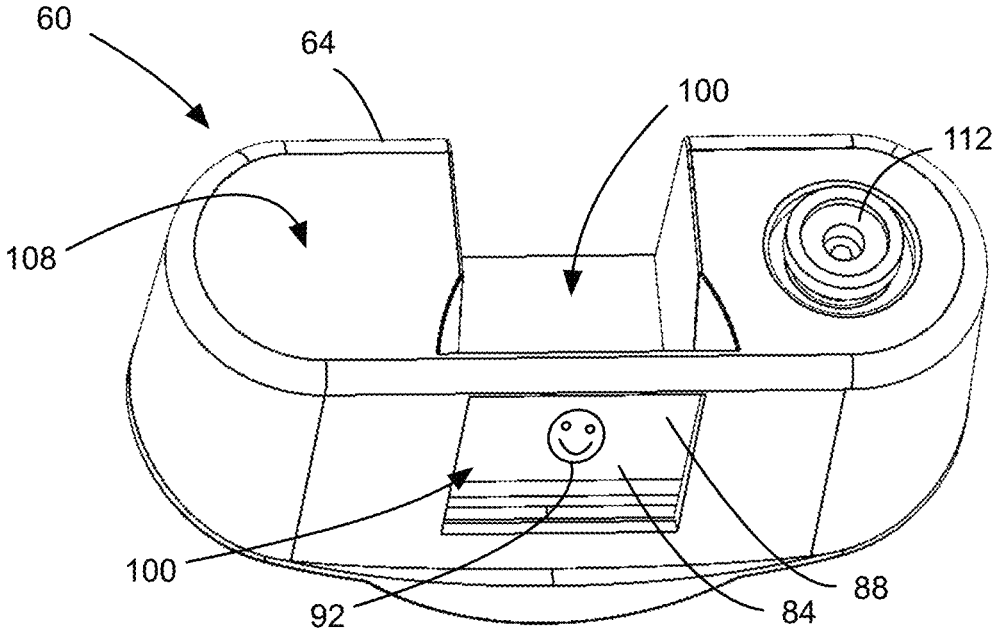
FIG. 8 is a bottom, front, left side perspective view of the cartridge of decal tape of FIG. 6.
Figure 9:
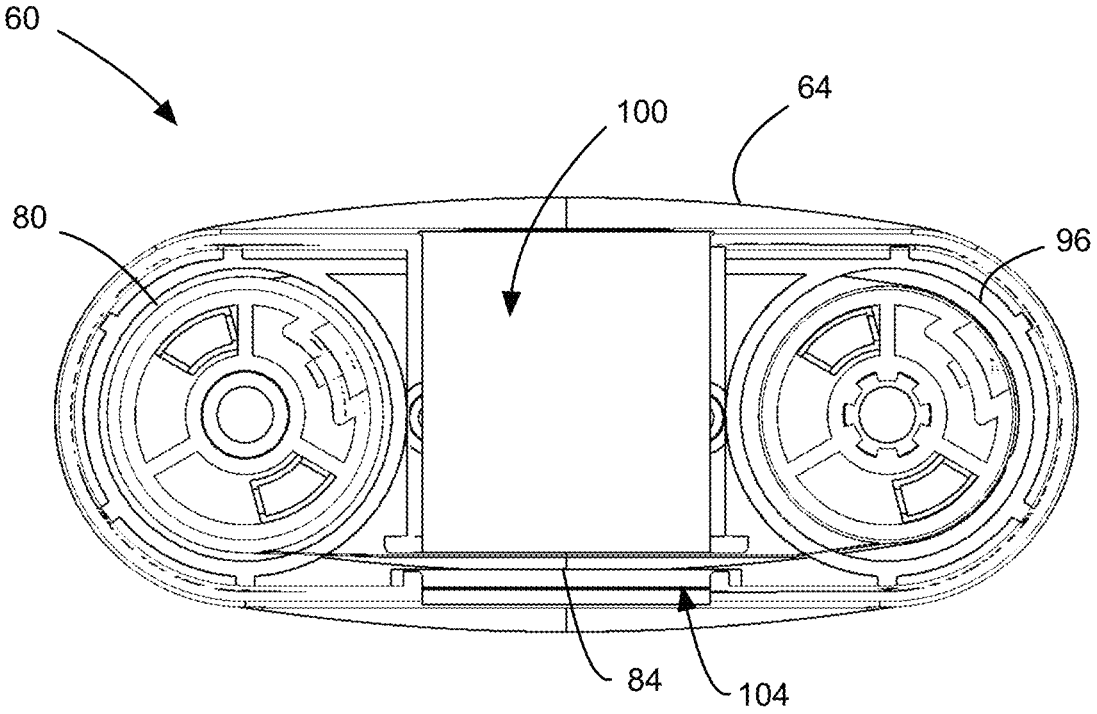
FIG. 9 is a front section view of the cartridge of decal tape of FIG. 6.
Figure 10:
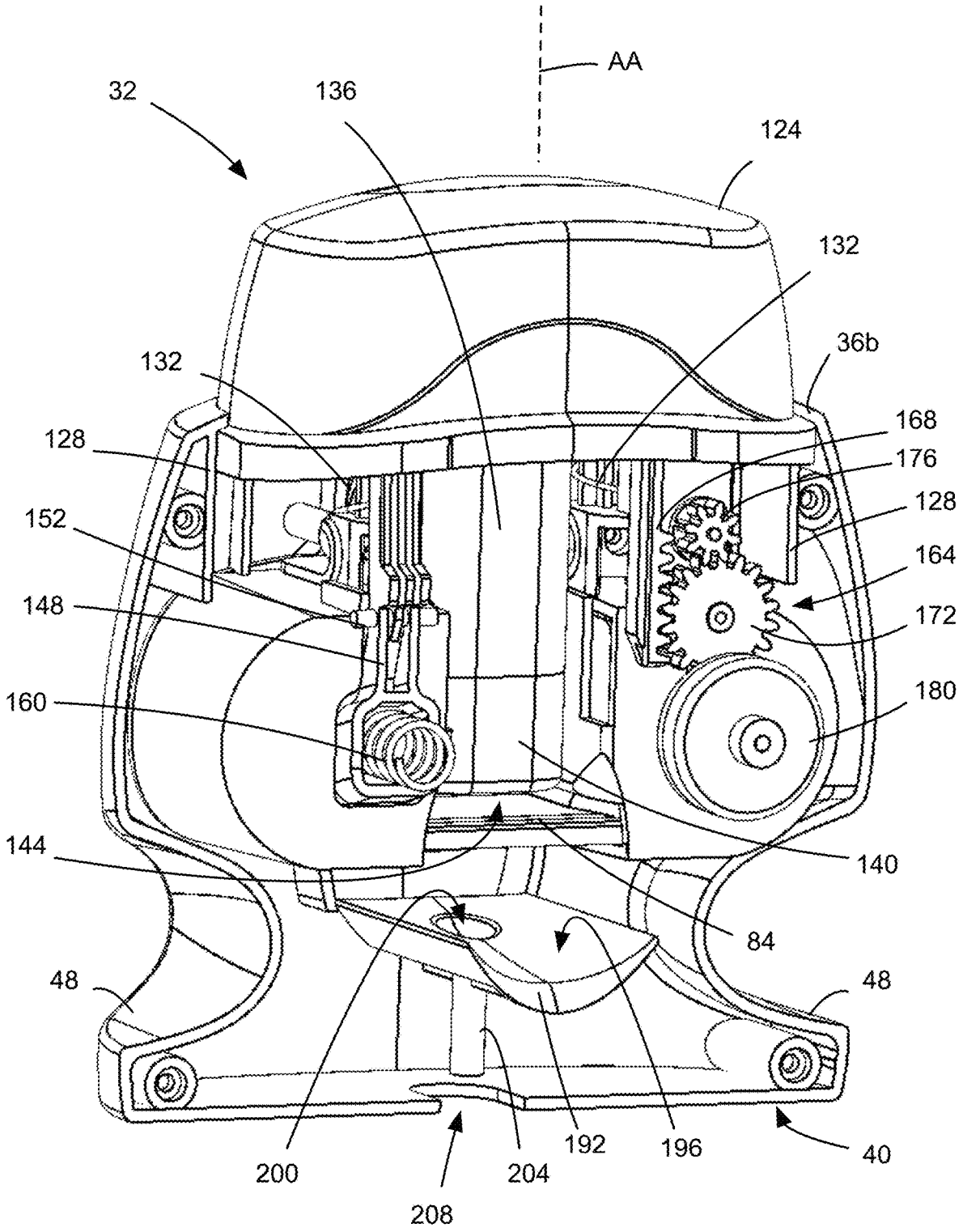
FIG. 10 shows a top, front, left side perspective view of the apparatus for applying a decal to a nail of FIG. 1 after removal of a front section of a housing thereof.

A cartridge recess 56 in the rear of the housing 36 shown in FIG. 5 is dimensioned to receive a decal tape cartridge 60. The cartridge recess 56 includes a supply spool recess 57 that can rotatably support a supply spool; that is, the supply spool recess 57 can accommodate a supply spool therein so that the supply spool can rotate. Further, the cartridge recess 56 includes a take-up spool recess 58 that can rotatably support a take-up spool.

FIGS. 6 to 9 show the decal tape cartridge 60 having a cartridge shell 64 that is profiled to correspond to the shape of the cartridge recess 56. A pull tab 68 extends from the cartridge shell 64 to enable its withdrawal from the cartridge recess 56. A lock slot 72 extends into the cartridge shell 64 close to a rear wall 76 thereof. A supply spool 80 is positioned inside of the cartridge shell 64 so that it freely rotates therein. Around the supply spool 80 is wound a length of decal tape 84. The decal tape 84 is a decal application product that includes a cellophane substrate 88 and at least one decal 92 adhered to the substrate 88. The decal tape 84 extends from the supply spool 80 to a take-up spool 96 having a tape grip that secures a leading edge of the decal tape 84. The tape grip can be a slot in the take-up spool 96 through which the decal tape 84 is inserted, a physical grip or clamp, a chemical or other bonding, etc. The take-up spool 96 is also freely rotatable within the cartridge shell 64. A central recess 100 extends between the supply spool 80 and the take-up spool 96. A span of the decal tape 84 extending between the supply spool 80 and the take-up spool 96 is exposed via an aligned pair of windows 104 in the cartridge shell 64.

A portion 108 of the cartridge shell 96 adjacent the supply spool 80 is sufficiently flexible to enable its deflection towards the supply spool 80, such that it is in contact with the supply spool 80. When the portion 108 of the cartridge shell 64 is in contact with the supply spool 80, friction between the portion 108 of the cartridge shell 64 and the supply spool 80 resist rotation of the supply spool 80 in the cartridge shell 64.

The take-up spool 96 is engaged by teeth of a transmission gear 112 that extends through the cartridge shell 64 and freely rotates with the take-up spool 96.

Referring now to FIGS. 1 to 12, the decal tape cartridge 60 is fitted into the cartridge recess 56 and secured by a lock projection 116 that is retractable via a lock lever 120.

An actuator 124 is slidingly received within a top aperture of the housing 36. Channel walls 128 within the housing 36 limit movement of the actuator 124 along an actuator axis AA. Two coil springs 132 bias the actuator 124 to an unactuated position shown in FIGS. 1 to 3, 5, and 10 to 12. A plunger 136 extends into the housing 36 from the actuator 124 along the actuator axis AA. The plunger 136 has a deflector in the form of a foam lower end 140 that is pliable and/or compressible, and has a decal application surface 144 at a distal end thereof. The decal application surface 144 is sized to fit within the windows 104 in the cartridge shell 64.

Figure 13:
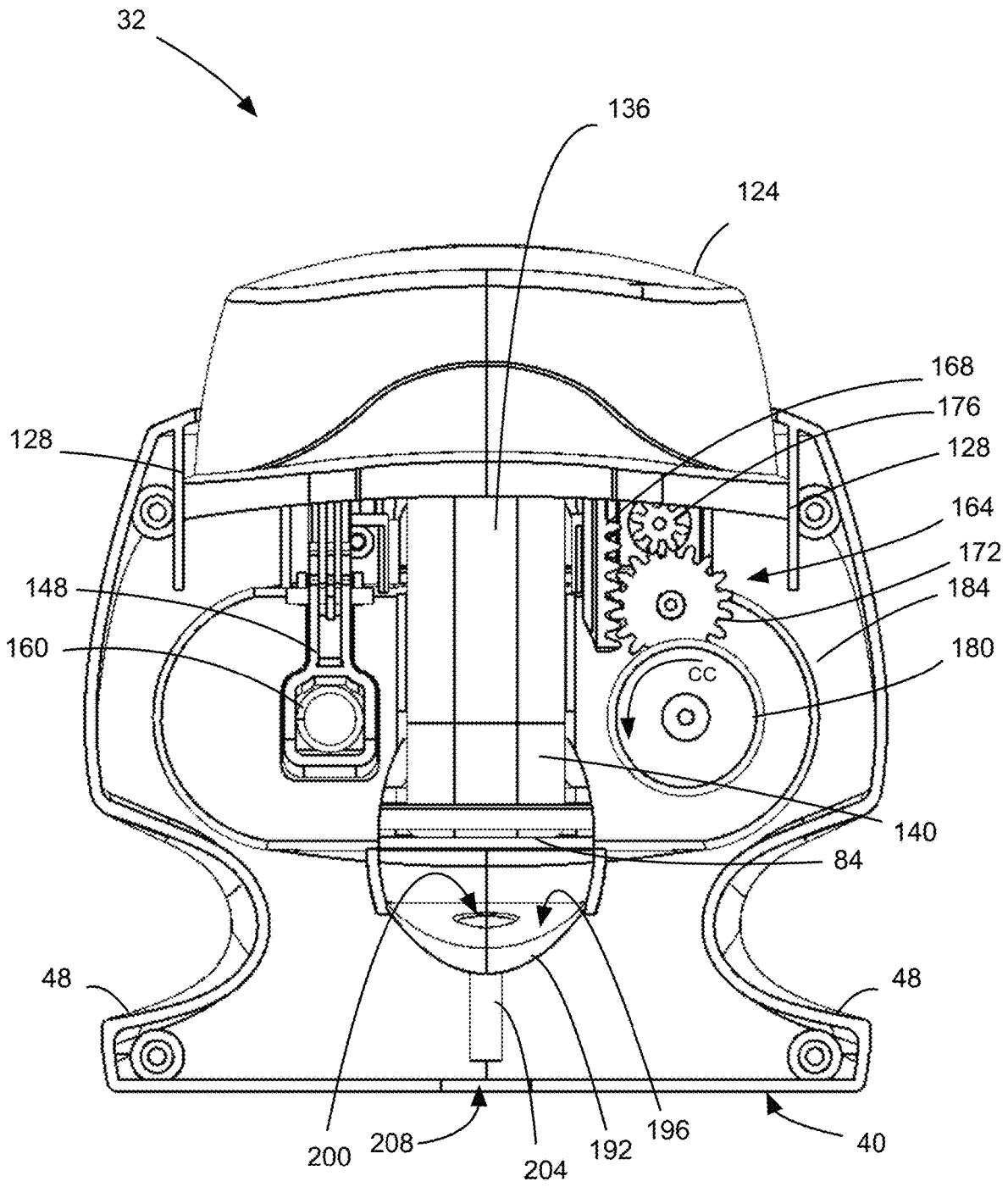
FIG. 13 shows a front elevation view of the apparatus for applying a decal to a nail of FIG. 1 after removal of a front section of the housing thereof, wherein the actuator is in an actuated position.

A tensioner bar 148 has a pair of pivot posts 152 that are pivotally held by the front housing section 36*a*. The tensioner bar 148 acts as a rotation inhibiter for the supply spool 80, and has a generally flat friction face 156 that faces the portion 108 of the cartridge shell 64 when the cartridge 60 is inserted into the nail printer 32. A biasing coil spring 160 biases the tensioner bar 148 such that the friction face 156 is pivoted towards and urged into contact with the portion 108 of the cartridge shell 64 to inhibit rotation of the supply spool 80 when the actuator 124 is in the unactuated position. A top end of the tensioner bar 148 is urged rearwardly when the actuator 124 is moved away from the unactuated position and towards an actuated position shown in FIG. 13. As the top end of the tensioner bar 148 is urged rearwardly, the tensioner bar 148 pivots about the pivot posts 152 to withdraw the friction face 156 from the portion 108 of the cartridge shell 64. Withdrawal of the friction face 156 from the portion 108 of the cartridge shell 64 allows the supply spool 80 to rotate freely within the cartridge shell 64. In alternative embodiments, other elements can be used to inhibit rotation of the supply spool 80, such as a surface having one or more teeth that engages one or more features of the supply spool, etc.

Figure 11:
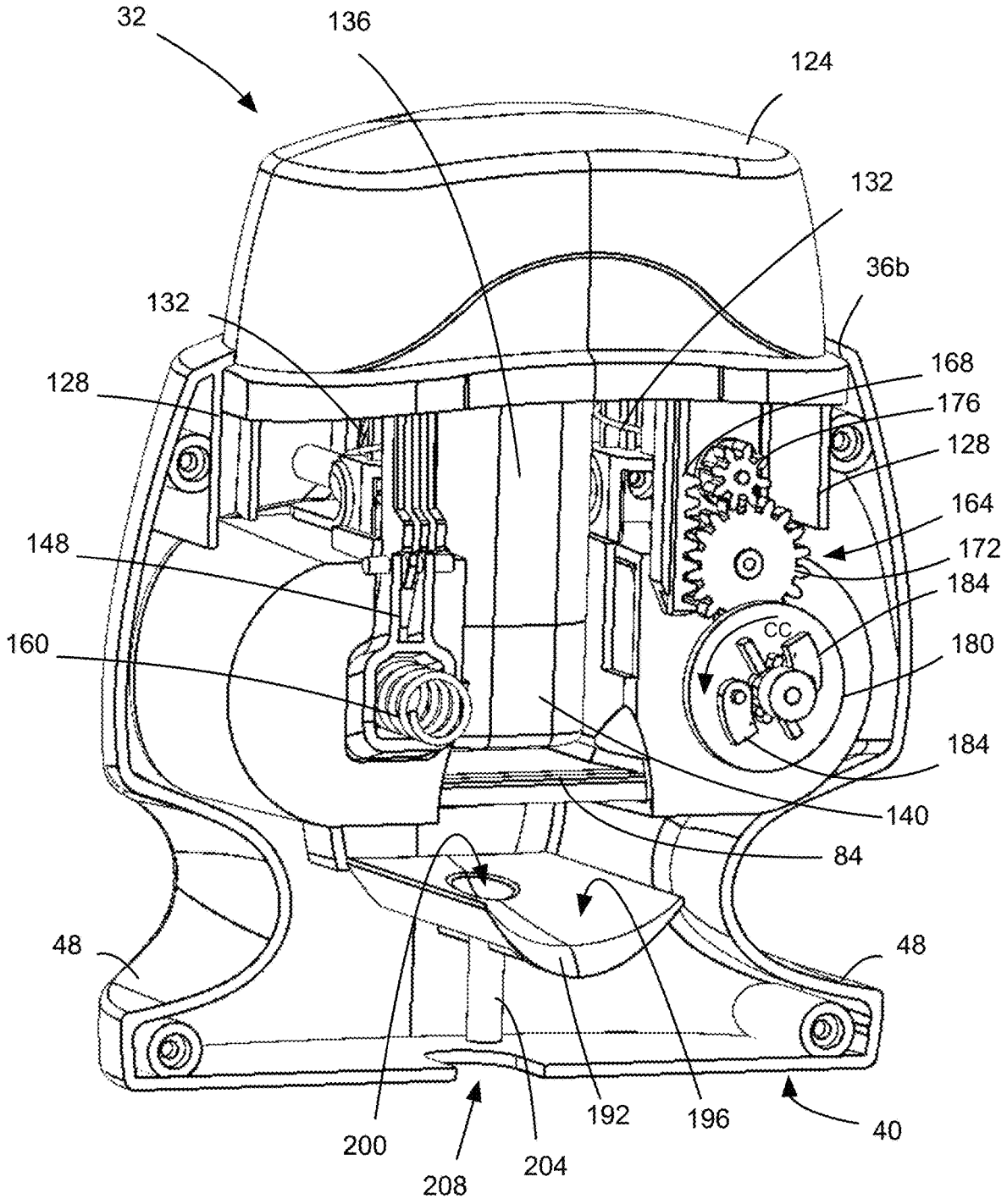
FIG. 11 shows the apparatus for applying a decal to a nail of FIG. 10 after removal of a pawl cover of a tape advancement arrangement thereof.
Figure 12:
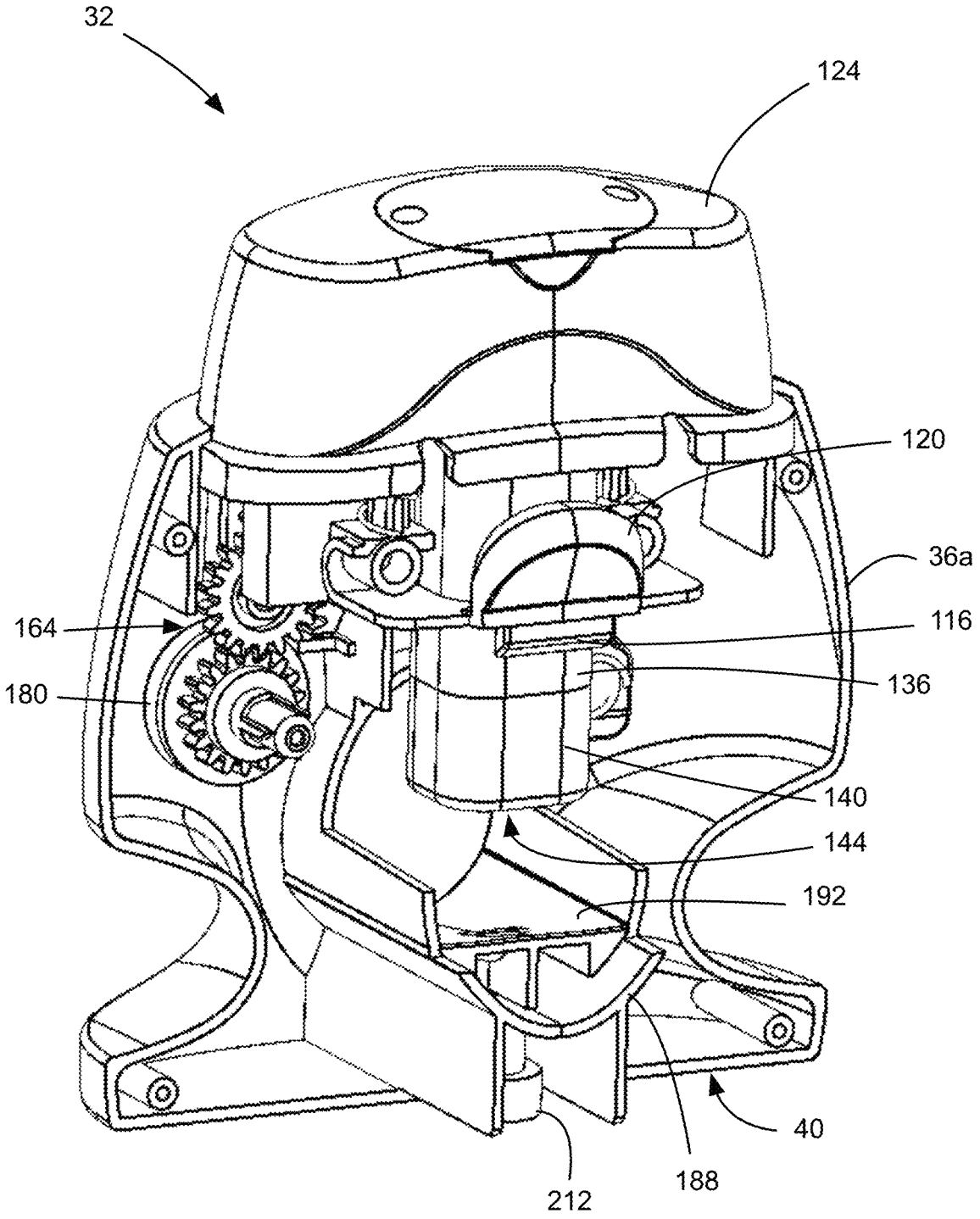
FIG. 12 shows a rear, top, right perspective view of the apparatus for applying a decal to a nail of FIG. 1 after removal of a rear section of the housing thereof.

A tape advancement arrangement 164 is also coupled to the actuator 124. The tape advancement arrangement 164 includes a toothed rack 164 that extends downwardly from the actuator 124. The toothed rack 164 engages teeth of a first gear 172 to rotate the first gear 172 as the toothed rack 164 is moved with the actuator 124. A stabilizer gear 176 supports the position of the first gear 172. The first gear 172 meshes with teeth of a drive gear arrangement 180. As shown in FIG. 11, a cap of the drive gear arrangement 180 is removed to expose two pawls 184 that restrict rotation of the drive gear arrangement in a counter-clockwise direction CC. Thus, as the actuator 124 is moved from the unactuated position to the actuated position, the drive gear arrangement 180 is not rotated. When the actuator 124 is urged back up towards the unactuated position from the actuated position, the drive gear arrangement 180 is rotated in the counter-clockwise direction CC, simultaneously engaging and rotating the take-up spool 96. As the take-up spool 96 is rotated in the counter-clockwise direction CC, the take-up spool 96 draws and wraps the decal tape 84 around itself. In alternative embodiments, the tape advancement arrangement can be any other structure to withdraw the decal tape 84 from the supply spool 80.

A longitudinal channel 188 (FIG. 12) of the front housing section 36*a* slidingly supports a finger rest 192. The longitudinal channel 188 is arcuate and generally level relative to the bottom surface 40. The finger rest 192 is dimensioned to sit within the longitudinal channel 188, and has a finger rest surface 196 that slopes downwards and frontwards towards the finger aperture 52. A positioning indentation 200 enables a person to locate their finger on the finger rest 192. The longitudinal channel 188 has a post channel 212 through which a finger rest post 204 of the finger rest 192 extends downwards. The post channel 212 is elongated longitudinally front-to-back. A correspondingly elongated slot 208 in the housing 36 exposes the post channel 212 and the post 204 extending downwardly therethrough.

The post 204 has an aperture in which a screw (not shown) is received to secure the finger rest 192 in a position within the longitudinal channel 188. The position of the finger rest 192 within the longitudinal channel 188 can be adjusted by loosening the screw, sliding the finger rest 192 longitudinally forwards or backwards, and then tightening the screw again once the finger rest 192 is in a desired position. The screw is recessed within the housing 36 when tightened.

Figure 14:
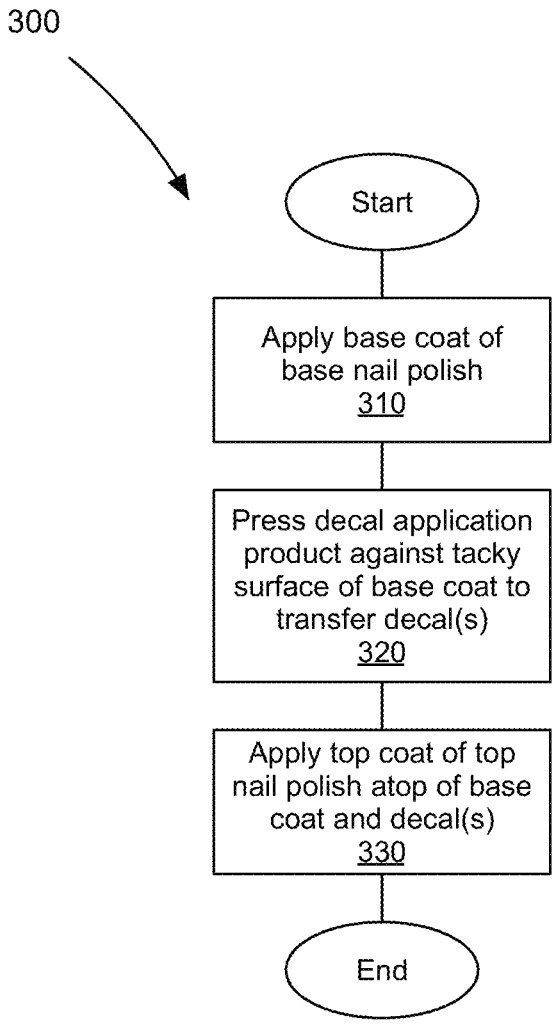
FIG. 14 shows the general method of applying a decal to a nail using the kit of FIG. 1.

A method 300 of decorating a nail of a human digit in accordance with an embodiment is shown in FIG. 14. The method 300 commences with the application of a base coat of the base nail polish 24 (310). The base nail polish 24 is applied to a nail in the same manner as a regular nail polish. After the base nail polish 24 has dried, it has a tacky surface.

Once the base coat has dried, a decal application product is pressed against the tacky surface of the base coat to transfer one or more decals (320). Where the nail printer 32 is used, the nail printer 32 is loaded with a decal tape cartridge 60 having a desired decal, if not presently loaded. The nail printer 32 is then positioned atop of a flat surface, such as a table. A user can then insert a finger into the finger aperture 52 while placing adjacent fingers atop of the grip surfaces 48 in the indents 44 and pressing down to steady the nail printer 32 atop of the flat surface. The user can position their finger on the finger rest surface 196 using the positioning indentation 200. Once the finger is positioned, the user can depress the actuator 124 to move the actuator 124 from the unactuated position to the actuated position. As the actuator 124 is moved from the unactuated position to the actuated position, the decal application surface 144 at the bottom of the plunger 136 contacts and deflects the decal tape 84 via the windows 104. As the decal tape 84 is deflected, it is moved into contact with the nail of the finger inserted into the finger aperture 52. One or more decals 92 on the decal tape 84 are pushed into contact with the tacky surface of the base coat of the base nail polish 24. The pliability/compressibility of the foam lower end 140 of the plunger 136 enables the foam lower end 140 to press the decal tape 84 into contact with the majority of the width of a variety of nail shapes and sizes.

The decals 92 and the cellophane substrate 88 adhere weakly to each other and have a first adhesion coefficient. The adhesion coefficient is a measure of the adhesion between two materials in normal operating circumstances for the application. That is, at normal temperatures and humidity levels, etc. The decals 92 and the tacky surface of the base coat of the base nail polish 24 have a second adhesion coefficient that is significantly greater than the first adhesion coefficient. That is, the decals 92 stick significantly more to the tacky surface of the base coat than they do to the cellophane substrate 88. As the adhesion coefficient between the decals 92 and the cellophane substrate 88 is lower than the adhesion coefficient between the decals 92 and the tacky surface of the base coat of the base nail polish 24, the one or more decals are transferred from the cellophane substrate 88 to the tacky surface. The adhesion coefficient between the cellophane substrate and the tacky surface of the base coat of the base nail polish 24 is sufficiently low so that the cellophane substrate 88 does not stick to the tacky surface of the base coat. Further, in the presently described embodiment, the adhesion coefficient between the decals 92 and a bare nail or a regularly polished nail is significantly lower than the adhesion coefficient between the decals 92 and the cellophane substrate 88, so that the decals do not readily transfer from the cellophane substrate 88 to a bare or regularly polished nail.

Once the decal tape 84 has been pushed into contact with the tacky surface of the base coat of the base nail polish 24, the actuator 124 can be released, and is moved from the actuated position to the unactuated position by the coil springs 132. As the actuator 124 moves from the actuated position to the unactuated position, the toothed rack 168 rotates the first gear 172 which, in turn, rotates the drive gear arrangement 180. The drive gear arrangement 180 engages the take-up spool 96 of the decal tape cartridge 60 and thereby rotates the take-up spool 96. As the take-up spool 96 rotates, the decal tape 84 is wound therearound, thus pulling the portion of the decal tape 84 that had the decals 92 applied to the nail towards it, and withdrawing unused decal tape from the supply spool 80.

The decals 92 are preferably spaced along the decal tape 84 so that the length of decal tape 84 that is moved across the windows 104 by each depression and release of the actuator 124 is predefined to correspond to the spacing between decals 92. In other words, the decals 92 are preferably spaced along the decal tape 84 by a spacing that corresponds to the length of decal tape 84 that is advanced by each depression and release of the actuator 124. In alternative embodiments, the spacing may be varied to modify the positioning of the decals 92 on a nail. In still further alternative embodiments, some or all of the entire surface of the cellophane substrate can be covered by a material that, when pushed into contact with a nail having a base coat of the base nail polish applied thereto, covers most of or all of the nail, thus defining a decal.

After one or more decals have been applied to the base coat on the nail, a top coat of the top nail polish 28 is applied atop of the base coat and the decal(s) (330). As the base coat has a tacky surface, it can be preferable to cover the tacky surface and applied decals 92 with a clear top coat that permits at least partial viewing of the decals 92 and the background base coat, and provides a relatively untacky surface.

Figure 15:
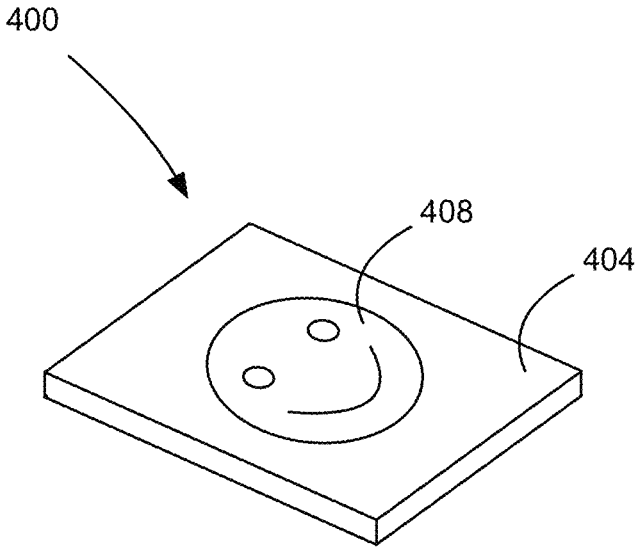
FIG. 15 shows a decal application product in accordance with an alternative embodiment.

FIG. 15 shows a decal application product 400 in accordance with another embodiment. The decal application product 400 is a sheet 404 with a single decal 408.

Figure 16:
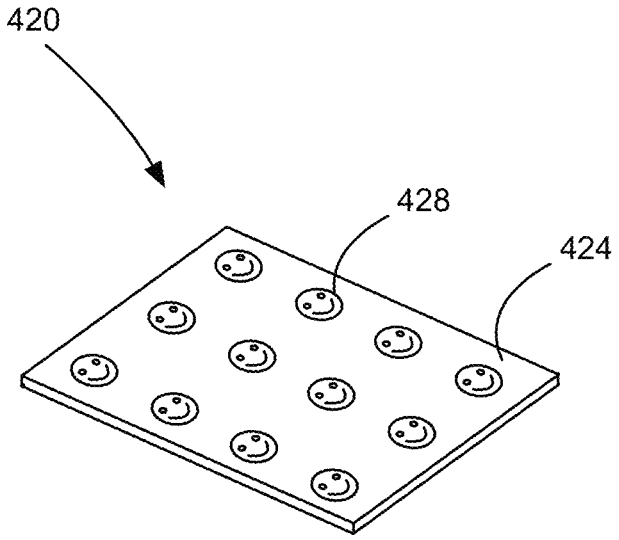
FIG. 16 shows a decal application product in accordance with a further alternative embodiment.

FIG. 16 shows a decal application product 420 in accordance with a further embodiment, wherein the decal application product 420 is a sheet 424 with a plurality of decals 428.

Figure 17:
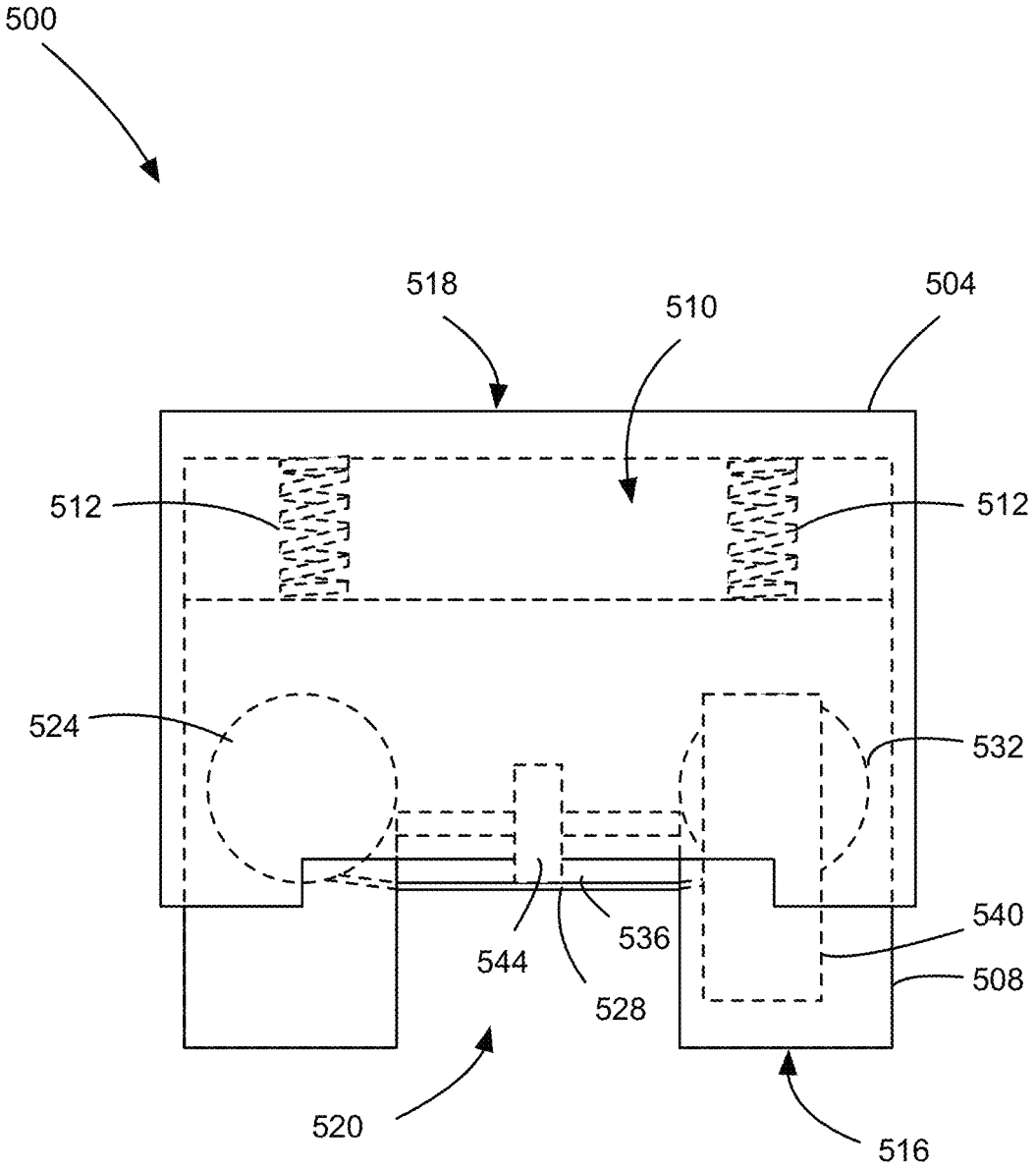
FIG. 17 shows an apparatus for applying a decal to a nail in accordance with another embodiment.

FIG. 17 shows an apparatus 500 for applying a decal to a nail of a human digit in accordance with another embodiment. The apparatus 500 has a housing 504 that is open on an underside thereof. A C-shaped actuator 508 is positioned inside of an interior recess 510 of and extends outwardly downwards from the housing 504. The actuator 508 is biased out of the interior recess 510 via a pair of biasing springs 512 to a unactuated position as shown, but is limited from fully exiting the housing 504 via a set of features (not shown). A bottom surface 516 of the actuator 508 is flat and designed to be rested on a flat surface, such as a table. A central gap 520 in the bottom surface 516 of the actuator 508 separates the bottom surface 516 into two portions.

A supply spool 524 is positioned inside of the interior recess 510 of the housing 504 and has at least a length of decal tape 528 wound thereon. The decal tape 528 is secured to a take-up reel 532 that is also positioned inside of the interior recess 510 of the housing 504. A decal application surface 536 is positioned beside the span of decal tape 528 extending between the supply spool 524 and the take-up spool 532.

Downward pressure on a top surface 518 of the housing 504 causes the housing 504 to compress the biasing springs 512 to further engulf the actuator 508 when the bottom surface 516 of the actuator 508 is positioned atop of a surface. Continued pressure on the top surface 518 of the housing 504 causes the actuator 508 to move to an actuated position mostly recessed within the interior recess 510 of the housing 504. In the actuated position, the bottom surface 516 of the actuator 508 extends down below the decal application surface 536 slightly less than the thickness of a child's finger (5-8 mm). The nail of a child's finger resting on the surface atop which the apparatus 500 is placed, is pressed into contact with the decal application surface 536 to transfer a decal from the decal tape 528 to the nail, which has a base coat of the base nail polish as described above. The decal application surface 536 is sufficiently pliable to conform to a range of nail shapes and sufficiently firm to press the decal tape 528 against the nail when the actuator 508 is moved towards the actuated position to transfer at least one of the at least one decal from the decal tape 528 to the nail.

A tape advancement arrangement 540 is intermediate the actuator 508 and the take-up spool 532. The tape advancement arrangement 540 rotates the take-up spool 532 as the actuator 508 moves from the actuated position towards the unactuated position as shown in FIG. 17, thereby advancing the decal tape 528 by winding it around the take-up spool 532.

A decal positioning light 544 is also located within the housing 504. The decal positioning light 544 uses an LED with a focusing arrangement, such as a pinhole or a lens to illuminate a position where it is expected that a decal will be positioned so that a nail can be aligned accordingly.

Figure 18:
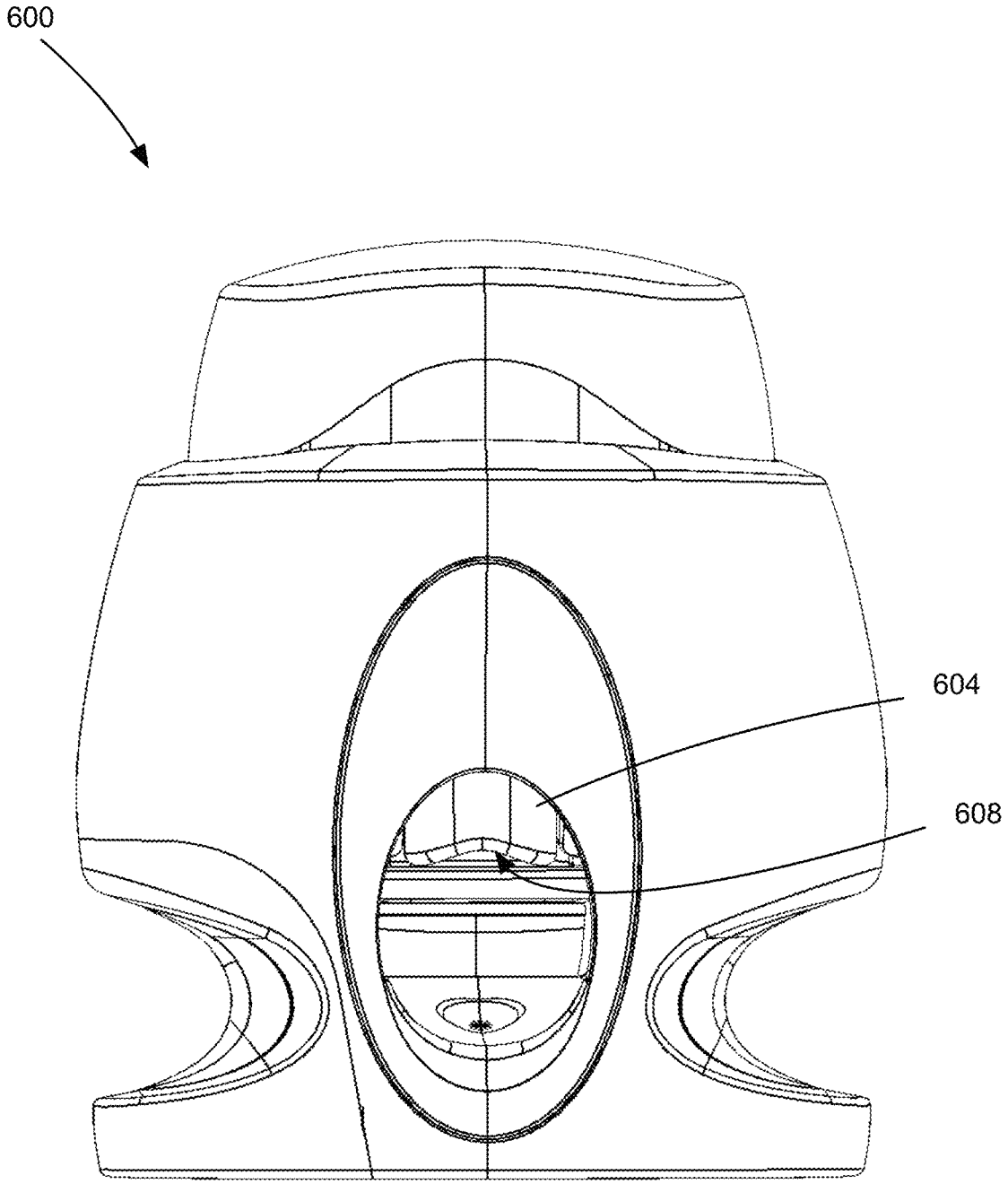
FIG. 18 shows an apparatus for applying a decal to a nail of a human digit in accordance with another embodiment.

FIG. 18 shows a nail printer 600 for applying a decal to a nail of a human digit in accordance with another embodiment. The nail printer 600 differs from the nail printer 32 shown in FIG. 1 in that it has a plunger 604 with an arcuate bottom surface to provide a decal application surface 608 that is arcuate to apply pressure to a decal tape positioned atop of a finger nail more evenly laterally across the finger nail.

While, in the above-described apparatus, the decal tape is deflected to contact the nail, in other embodiments, the finger can be deflected so that the nail contacts the decal tape. In further alternative embodiments, both the finger and the decal tape can be deflected towards one another.

While the decal application products described above employ a cellophane substrate, other substrates and decal materials can be employed.

The decals can be provided with dimensions to provide the overall finished nail a particular texture.

While, in the above-described embodiments, there are disclosed methods, kits, and apparatuses for applying decorations are described with reference to finger nails, it will be appreciated that they all also can be used to apply decorations to nails of other human digits; i.e., toe nails.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. An apparatus for decorating nails, comprising:

a housing having a cartridge recess;

a cartridge that includes a supply spool around which a tape is at least partially wound, the tape having at least one decal that is transferrable to a nail of a human digit, and a take-up spool that includes a tape grip that holds an end of the tape, wherein the cartridge is removably mountable in the cartridge recess;

an actuator coupled to the housing and moveable between an unactuated position and an actuated position;

a tape advancement arrangement coupled to the actuator and arranged to rotate the take-up spool to extend the tape from the supply spool during movement of the actuator between the unactuated position and the actuated position; and a decal application surface coupled to at least one of the housing and the actuator, the decal application surface being sufficiently firm to press the tape against the nail when the actuator is moved towards the actuated position to transfer at least one of the at least one decal from the tape to the nail.

2. An apparatus as claimed in claim 1, further comprising a rotation inhibitor positioned to inhibit rotation of the supply spool when the actuator is in the unactuated position.

3. An apparatus as claimed in claim 2, wherein the rotation inhibitor is biased against the supply spool when the actuator is in the unactuated position so as to drive engagement of the supply spool and a friction face, so as to inhibit rotation of the supply spool via friction.

4. An apparatus as claimed in claim 1, wherein the tape advancement arrangement includes a ratcheted gear that is unrotated as the actuator is moved from the unactuated position to the actuated position, and rotated as the actuator is moved from the actuated position to the unactuated position.

5. An apparatus as claimed in claim 1, wherein the tape advancement arrangement extends at least a predefined length of the tape from the supply spool as the actuator is moved from the unactuated position to the actuated position and back to the unactuated position.

6. An apparatus as claimed in claim 5, wherein the actuator is biased towards the unactuated position via at least one actuator biasing element.

7. An apparatus as claimed in claim 6, further comprising:

a deflector coupled to the actuator and having the decal application surface, the deflector being movable, via movement of the actuator from the unactuated position to the actuated position, to deflect at least one of a span of the tape extending between the supply spool and the tape grip, and a finger of a user such that the span of the tape and the finger are moved into contact with one another.

8. An apparatus as claimed in claim 7, wherein the deflector deflects the span of the tape extending between the supply spool and the tape grip when the actuator is moved from the unactuated position to the actuated position.

9. An apparatus as claimed in claim 5, wherein the tape advancement arrangement rotates the take-up spool to extend the tape as the actuator is moved from the actuated position to the unactuated position, and wherein the take-up spool is unrotated by the tape advancement arrangement as the actuator is moved from the unactuated position to the actuated position.

* * * * *